United States Patent [19]

Reale

[11] 4,215,670

[45] Aug. 5, 1980

[54] COOKING GRATE

[75] Inventor: Salvatore Reale, Preston, Md.

[73] Assignee: Sunergy Corporation, Preston, Md.

[21] Appl. No.: 921,077

[22] Filed: Jun. 30, 1978

Related U.S. Application Data

[63] Continuation-in-part of Ser. No. 764,968, Feb. 2, 1977, abandoned.

[51] Int. Cl.[2] ..... F23H 13/00

[52] U.S. Cl. ..... 126/164

[58] Field of Search ..... 126/120, 121, 131, 164, 126/165, 400, 298, 274

[56] References Cited

U.S. PATENT DOCUMENTS

| | | | |
|---|---|---|---|
| 1,412,717 | 4/1972 | Stowell | 126/400 |
| 4,076,012 | 2/1978 | Meeker | 126/164 |
| 4,078,542 | 3/1978 | Young | 126/164 |

FOREIGN PATENT DOCUMENTS

| | | | |
|---|---|---|---|
| 93149 | 10/1938 | Finland | 126/165 |
| 527934 | 10/1940 | United Kingdom | 126/164 |

*Primary Examiner*—James C. Yeung

[57] ABSTRACT

A device designed to extract heat from a fire or flames, and by the principle of conduction and convection channel this same heat into the desired or required area or system. The principle used is to immerse the structural members which are formed from materials which are good conductors of heat and resistant to deterioration or destruction by the temperatures found in fire, heat, or flames and have the structural members provide the heat where so desired. The structural members may be of solid construction throughout or they may be fashioned from hollow members with a gaseous or liquid type conductor or convector of heat of the heat pipe type within the same structural members. As the portion of the structural members contained in the fire absorb heat, this heat will be conducted to where it is desired by the aforementioned principle of conduction or convection.

There is an air deflection system composed of two parts, one of which is the cooking plate and the other the curved deflector surface. The cooking plate which is capable of being latched in an angular position serves as an air deflector when in that position, but when the latch is released and the cooking plate laid flat on the structural members, enough heat may be obtained for the purpose of cooking or other use. The air deflector plate may be curved or flat, metallic or glasseous in nature and may be selectively positioned from tightly against the fireplace opening to a multitudinous number of positions to effectively act as an air shield or barrier thereby preventing the selective portion of warmed or unwarmed room air from entering the fireplace.

6 Claims, 3 Drawing Figures

COOKING GRATE

CROSS REFERENCE TO RELATED APPLICATION

This application is a continuation-in-part of Ser. No. 764,968 filed Feb. 2, 1977 now abandoned.

BRIEF SUMMARY OF THE INVENTION

A device which is used as a source of heat insomuch as being in contact with or immersed in fire, flame, hot coals or ashes caused by the burning of wood, coal, gas or other combustble materials which combustion will be called the fire, said device having the novel and new feature of conducting heat from the source into a room or area where the heat is desired, this being accomplished by the use of solid, or partially solid or hollow structural members which in the case of the partially solid or hollow members may contain a gas, liquid, or other substance arranged in such a manner as to provide for efficient conduction of heat from the end of the grate being heated to the end of the grate where the heat is desired, this heat thus conducted away from the fire may be utilized for space heating or cooking primarily but may be used for any purpose where heat is required. Cooking may be accomplished by resting cooking utensils directly on the structural members and the heating fins of the grate, or by placing a flat plate consisting of a metallic or glasseous material, or other suitable material upon the structural members and heating fins and using said plate as a cooking surface, said flat plate may be used singly or in conjunction with a heat deflecting device of metallic or glass construction which is positioned most advantageously and may vary in a plurality of positions from a position directly above the heating fins to a position directly in front of the fireplace opening, the prime object of the heat deflecting device being the prevention of the loss of air from the room area by the entry of the air into the fireplace opening.

DETAILED DESCRIPTION OF THE DRAWING

In FIGS. #1, 2 and 3, Element #1, the Heating Plate metallic in nature and in conjunction with the Retaining Bars, Element #4, FIGS. #1 and 2 are provided primarily for the purpose of confining combustible materials within them and between them while at the same time absorbing heat from the ignited material, said heat will be absorbed by the Structural Members Element #2, FIGS. #1, 2, and 3 to which they are fastened, said Structural Members upon which the fire rests and which are also heated by the hot coals and ashes, are designed and manufactured with inherent properties of quickly absorbing heat and ease of heat conduction from one end of said Member to the other end of the same member; said Members may be solid or hollow or partially filled with liquid or gas, whichever of these materials are most conductive to the transfer of heat from one end of the Structural Member to the other end. Heating Fins Element #5, FIGS. #1, 2, and 3 are thin metallic strips made of good heat conducting material which are placed in contact with the Structural Members in such a manner that heat is readily absorbed by the Heating Fins from the Structural Members so this heat may then be either dissapated to the surrounding air or else be utilized for cooking or other purposes such as when a utensil of some sort is placed upon the Heating Fins and the Structural Members.

Figure 1:
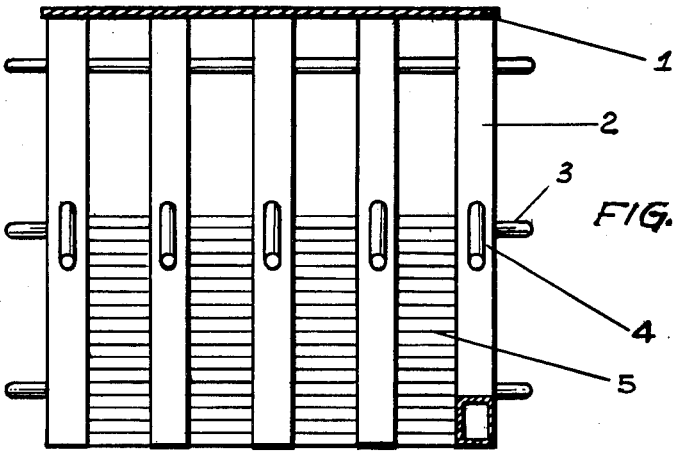
FIG 1. is a top view of the grate structure.
Figure 2:
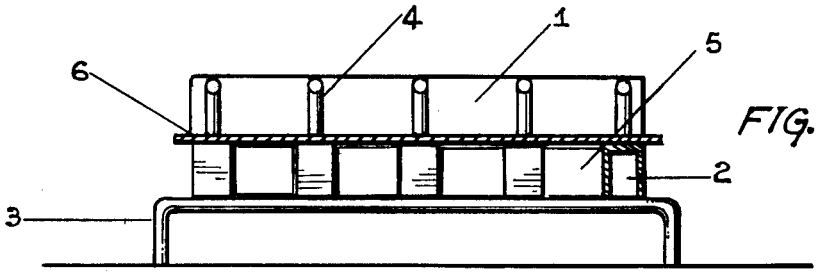
FIG. 2 is an end view of the grate shown in FIG. 1.
Figure 3:
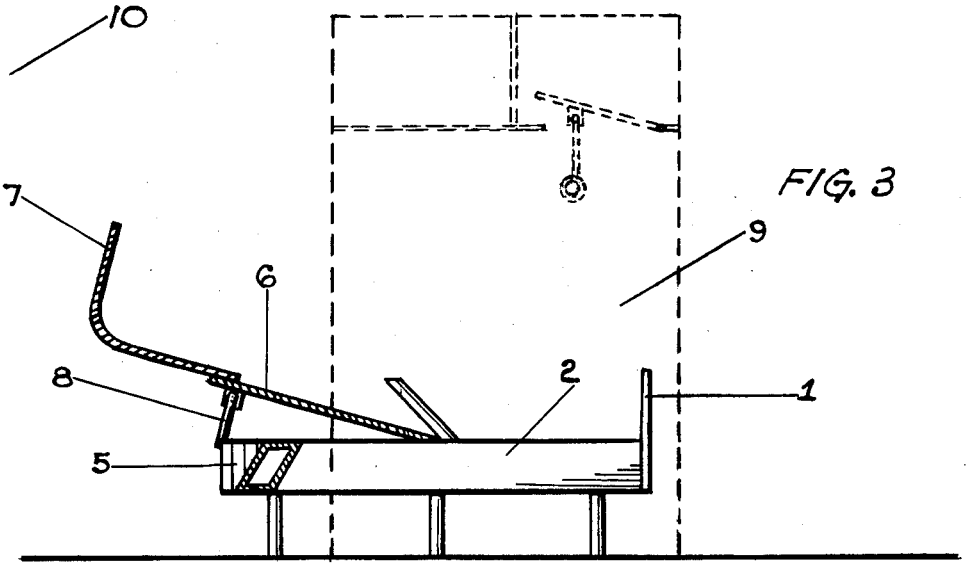
FIG. 3 is a side view of the grate shown in FIG. 2.

Supporting Legs Element #3 FIGS. #1 and 2 are Legs fashioned to hold the Structural Members and the entire body of the Cooking Grate a sufficient distance above it's resting place so as to provide an area of adequate depth for air to enter the fire and also for the accumulation of ashes and also to provide and area for cool air to to enter the Heating Fins; said cool air may so enter the space around the Heating Fins thereby being warmed, and as said warmed rises providing a source of heat for the Room Area, Element #10 FIG. #3. The Cooking Plate, Element 6, FIGS. #2 and 3 may be used for two different purposes. It may be used to deflect warmed air when placed in it's raised position and latched by the Latching Device, Element 8, FIG. #3, or by release of the Latching Device may be used as a griddle or cooking surface when lying upon or in contact with the Structural Members and Heating Fins as shown in FIG. #2. The Curved Deflector Plate, Element #7, FIG. 3 is an extension of the Cooking Plate or may be fashioned independently of the Cooking Plate and may be used as an air deflector without the use or need of the Cooking Plate with the use of said Curved or flat Deflector to prevent air from entering the Fireplace Opening Element #9, FIG. 3. The Cooking Plate and the Deflector Plate being of such composition and placement so as to allow the maximum of radiated heat from the fire to enter the Room Area but at the same time preventing heated air extracted from the fire by the conduction process performed by the Cooking Grate to enter the Fireplace Opening and thereby be lost as a source of heat.

What is claimed is:

1. A fireplace grate for conducting heat from a fire to a point outside of the fireplace comprising;

A. a plurality of structural members extending from a point interior of a fireplace to a point exterior of a fireplace;

B. means supporting the structural members above the floor of the fireplace and providing rigidity to the structural members to form a monolithic unit, C. a plurality of fins attached between the structural members in a manner to provide an optimim transfer of heat, the fins extending perpendicularly to the structural members, D. the fins being attached to the portion of the strucure members exterior of the fireplace, E. a bar fastened to each of the structural members to prevent logs from rolling out of the fireplace, F. a first plate means extending across the rear of the structural members to prevent logs rolling off the back of the grate, G. a second plate means provided to over lie the portion of the structural members exterior of the fireplace to provide a cooking surface, H. a deflector means attached to the second plate means for deflecting air from the fireplace opening and thereby preventing the entry of heated air into the fireplace, I. a latch means fastened to the second plate means for adjusting the position of said second plate means and said reflector means.

2. The fireplace grate according to claim 1 wherein the structural members are solid metal.

3. The fireplace grate according to claim 1 wherein the structural members are hollow tubes.

4. The fireplace grate of claim 3 wherein the hollow tubes are filled with a liquid.

5. The fireplace grate of claim 3 wherein the hollow tubes are filled with a gas.

6. The fireplace grate of claim 3 wherein the hollow tubes are heat pipes.

* * * * *